United States Patent [19]

Lee

[11] Patent Number: 5,033,630

[45] Date of Patent: Jul. 23, 1991

[54] PANTS RACK DEVICE

[76] Inventor: Gordon G. Lee, Box 315, 10 Church Street, Arnolds Cove, Newfoundland, Canada, A0B 1A0

[21] Appl. No.: 529,619

[22] Filed: May 29, 1990

[51] Int. Cl.[5] ..... A47F 7/00

[52] U.S. Cl. ..... 211/96; 211/168

[58] Field of Search ..... 211/96, 168, 110, 116

[56] References Cited

U.S. PATENT DOCUMENTS

| | | | |
|---|---|---|---|
| 368,036 | 8/1887 | Westfall | 211/96 |
| 416,685 | 12/1889 | Nichols | 211/96 |
| 1,236,169 | 8/1917 | Hentnik | 211/96 |
| 1,651,969 | 12/1927 | Saxton | 211/96 X |
| 2,485,201 | 10/1949 | Jewett | 211/96 |
| 2,975,907 | 3/1961 | Hirsch | 211/96 |
| 2,987,193 | 6/1961 | Pajor | 211/96 X |

*Primary Examiner*—Carl D. Friedman
*Assistant Examiner*—Sarah A. Lechok
*Attorney, Agent, or Firm*—Henderson & Sturm

[57] ABSTRACT

A pants rack device (10) for supporting and suspending pairs of pants (100) which includes a pair of vertical support units (12) rotatably supported in a housing unit (11) wherein each of the vertical support units (12) is provided with a plurality of spaced dowel members (25) from which one or more pair of pants (100) may be suspended.

3 Claims, 1 Drawing Sheet

FIG. 1.
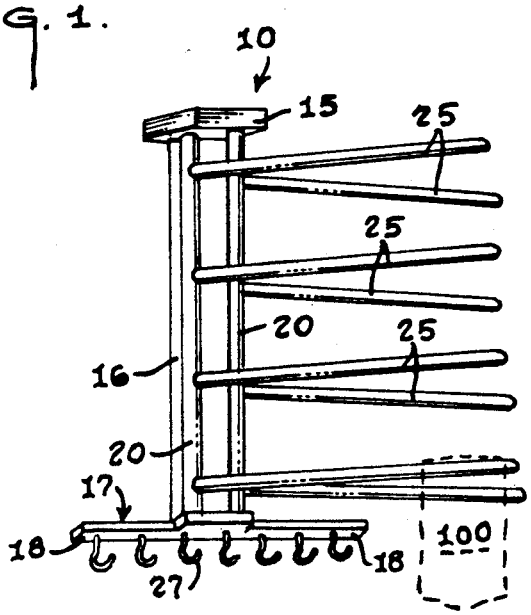
FIG. 3.
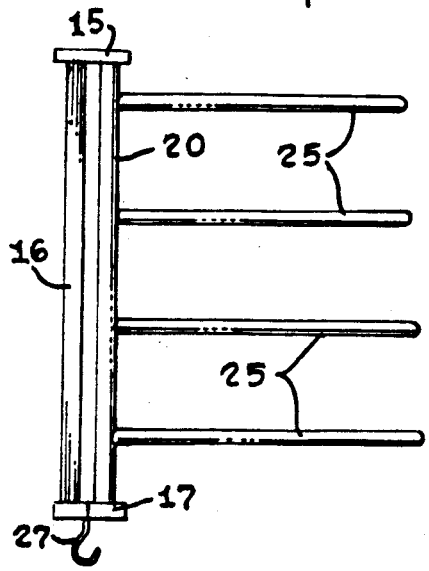
FIG. 4.
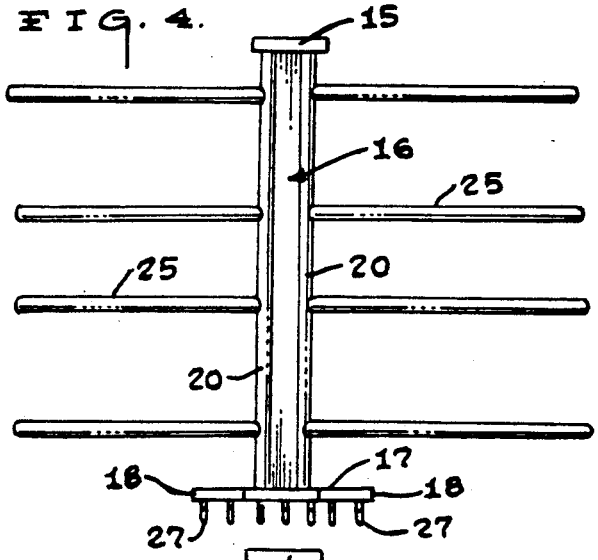
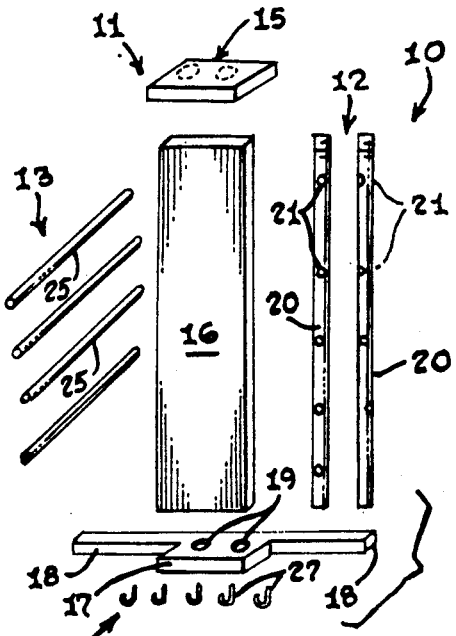
FIG. 2.
FIG. 5.
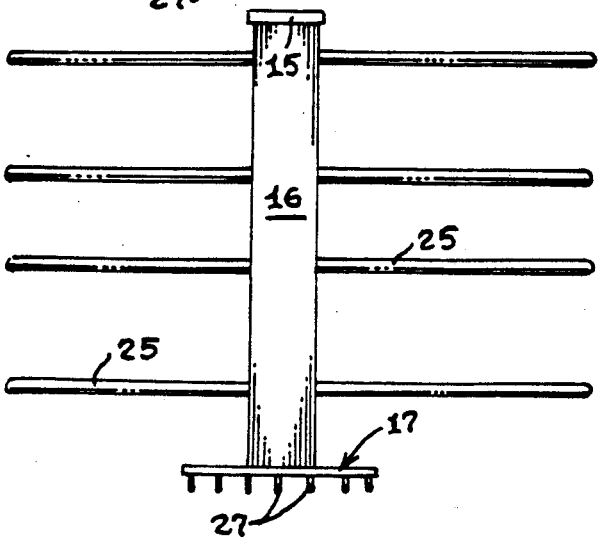

PANTS RACK DEVICE

TECHNICAL FIELD

The present invention relates to the field of clothes hangers in general, and in particular to a foldable clothes rack for pants.

BACKGROUND ART

This invention was the subject matter of Document Disclosure Program Registration No. 216394 which was filed in the U.S. Patent and Trademark Office on Dec. 19, 1988.

As can be seen by reference to the following U.S. Pat. Nos. 4,323,162; 4,109,794; 4,632,255; and 4,625,873; the prior art is replete with myriad and diverse clothes hangers.

While all of the aforementioned prior art constructions are more than adequate for the basic purpose and function for which they have been specifically designed, they do not address the specialized problem of hanging a number of pants in an orderly and efficient manner.

As most business people are well aware, the problem of finding a hanger and hanging up a pair of pants is an everyday annoyance. Most closets already have a considerable amount of clothing in them so the locating of an available hanger becomes a troublesome task.

The hanging of a pair of pants on a conventional hanger is also a time consuming task. Furthermore there is the problem of retrieving the pants from the closet. This is due to the fact that the shirts and jackets in the closet sometimes cover the pants up, making them hard to find.

These prior art problems involved with the hanging of pants can result in the pants not being hung up a great deal of the time, but just placed over a chair or thrown on a bed, particularly when dealing with most children and even some adults.

Therefore, there has been a pressing need for a device to hang pants in a neat and efficient manner. This device should also be able to accommodate multiple numbers of pants and be susceptible to mounting on any verticle surface in a bedroom or walk-in closet; and the provision of such a device is a stated objective of the present invention.

SUMMARY OF THE INVENTION

An object of the present invention is to provide a pants rack that can be used to hang a number of pairs of pants.

Another object of the present invention is to provide a pant rack device with a plurality of laterally movable support elements for supporting and storing the individual pairs of pants.

Still another object of the present invention is to provide a pant rack device with two rotatably mounted support members designed to receive the plurality of support elements.

A further object of the present invention is to provide a pant rack device with upper and lower housing units which have aligned apertures for receiving the vertical support members. These apertures allow the support members to swivel, which in turn rotates the laterally movable support elements into position for the storage or retrieval of a pair of pants.

Yet another object of the present invention is to provide a pant rack device with a lower unit which is provided with a plurality of hook elements for suspending a plurality of diverse articles below the rack device, such as ties, belts, or the like.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the pants rack device of this invention;

FIG. 2 is an exploded perspective view of the device;

FIG. 3 is a side view;

FIG. 4 is a front view; and,

FIG. 5 is a rear view.

BEST MODE FOR CARRYING OUT THE INVENTION

As can be seen by reference to the drawings and in particular to FIG. 4 the pant rack device that forms the basis of the present invention is designated generally by the reference numeral (10). The device (10) comprises in general: a housing unit (11), a plurality of vertical support units (12), a plurality of horizontal support units (13), and a plurality of hook units (14). These units will now be described in seriatim fashion.

The housing unit (11) comprises a generally rectangular upper housing member (15), an elongated rectangular wall member (16), and a generally rectangular lower housing member (17) having a pair of arm elements (18) which project outwardly from the sides of the lower housing member (17); wherein the upper (15) and lower (17) housing members are operatively attached to opposite ends of the wall member (16) and project outwardly therefrom in a cantilever fashion. Furthermore both the upper and lower housing members (17) are provided with a plurality of opposed and aligned recesses (19) whose purpose and function will be described presently.

Still referring to FIG. 2 it can be seen that each of the plurality of vertical support units (12) comprise an elongated generally cylindrical vertical rod member (20) having a plurality of spaced apertures (21) extending along the length of the rod member (20); wherein the ends of the rod members (20) are dimensioned to be rotatably received in the aligned recesses (19) in the housing unit (11).

At this juncture it should be noted that although the apertures (21) in the vertical rod member (20) are depicted as being vertically aligned with one another, this invention also contemplates the use of an offset relationship between the apertures for reasons that will be explained further on.

The horizontal support units (13) each comprise an elongated dowel member (25) having one end which is dimensioned to be received in the apertures formed in the respective rod members (20) whereby the dowel members (25) will be horizontally disposed relative to the vertical rod members (20) as depicted in FIGS. 3 through 5.

The hook units (14) each comprise hook members (27) which are adapted to be secured to the bottom of the lower housing member (17) and/or the bottom of the arm elements (18) to support and suspend such diverse articles (not shown) as shirts, ties, belts, etc.

At this juncture it should also be appreciated that the wall member (16) of the housing unit (11) is intended to be mounted on a vertical wall surface by suitable securing means (not shown) to elevate the device (10) above the floor to suspend one or more pair of pants (100) from each of the dowel members (25). In addition, as mentioned previously the dowel members (25) may be vertically aligned on the respective rotatable rod members (20) or offset on the rod members (20) to allow a staggered suspension of the pants (100) to facilitate the storage and retrieval of the pants from the device.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pants rack device for supporting and suspending pairs of pants wherein the device consists of:

a housing unit including an upper housing member and a lower housing member connected to a wall member in cantilever fashion wherein the upper and lower housing members are provided with a plurality of pairs of aligned and opposed recesses; and, wherein the lower housing member is further provided with a plurality of arm elements which project outwardly from the sides of the lower housing member and a plurality of hooks which depend downwardly from said arm elements;

a vertical support unit comprising a pair of elongated rod members whose ends are dimensioned to be rotatably received in the said plurality of pairs of recesses wherein the rod members are further provided with a plurality of spaced apertures; and, a horizontal support unit including a plurality of elongated dowel members having one end dimensioned to be received in said apertures.

2. The device as in claim 1 wherein said spaced apertures are vertically aligned relative to said rod members.

3. The device as in claim 1 wherein said spaced apertures are vertically offset from one another relative to said rod members.

* * * * *